US007294156B2

(12) United States Patent
Chakrabarty et al.

(10) Patent No.: US 7,294,156 B2
(45) Date of Patent: Nov. 13, 2007

(54) INTEGRATED PROCESS FOR BITUMEN RECOVERY, SEPARATION AND EMULSIFICATION FOR STEAM GENERATION

(75) Inventors: Tapantosh Chakrabarty, Calgary (CA); Mainak Ghosh, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 372 days.

(21) Appl. No.: 10/646,134

(22) Filed: Aug. 22, 2003

(65) Prior Publication Data

US 2004/0055208 A1 Mar. 25, 2004

(30) Foreign Application Priority Data

Sep. 23, 2002 (CA) ..... 2404586

(51) Int. Cl.
*C10L 1/32* (2006.01)

(52) U.S. Cl. ..... 44/301; 44/51; 44/280; 44/561; 44/569; 44/628; 60/780; 62/607; 166/266; 208/390; 208/391; 516/43; 516/47

(58) Field of Classification Search ..... 44/51, 44/280, 301, 561, 569, 628; 60/780; 106/277; 166/266; 208/390, 391; 62/607; 516/43, 516/47, 926, 928
See application file for complete search history.

(56) References Cited

U.S. PATENT DOCUMENTS

| | | | | |
|---|---|---|---|---|
| 4,119,149 | A * | 10/1978 | Wu et al. | 166/266 |
| 4,331,532 | A * | 5/1982 | Bose | 208/391 |
| 4,666,457 | A | 5/1987 | Hayes et al. | 44/51 |
| 5,876,592 | A * | 3/1999 | Tipman et al. | 208/390 |
| 6,066,186 | A * | 5/2000 | Matsumoto | 44/301 |
| 6,113,659 | A | 9/2000 | Logaraj et al. | 44/280 |
| 6,187,063 | B1 * | 2/2001 | Gunnerman | 44/301 |

OTHER PUBLICATIONS

Sankey, B.M., Ghosh, M., and Chakrabarty, T. (1995) "Bitumen Utilization via Partial Upgrading and Emulsification", 6th UNITAR International Conference on Heavy Crude and Tar Sands, vol. 2, Feb. 12-17, 1995, p. 269-276.

* cited by examiner

*Primary Examiner*—Glenn Caldarola
*Assistant Examiner*—Prem C. Singh

(57) ABSTRACT

The invention relates to a process for splitting bitumen into two fractions and rendering a heavier bottom fraction as a useable emulsion fuel. The process is particularly effective in creating an alternate fuel to natural gas in a steam-based bitumen recovery process wherein bitumen is recovered from an underground reservoir.

15 Claims, 2 Drawing Sheets

INTEGRATED PROCESS FOR BITUMEN RECOVERY, SEPARATION AND EMULSIFICATION FOR STEAM GENERATION

This application claims priority from Canadian Patent Application No. 2,404,586 filed Sep. 23, 2002.

FIELD OF THE INVENTION

The invention relates to a process for splitting bitumen into two fractions and rendering a heavier bottom fraction as a useable emulsion fuel. The process is particularly effective in creating an alternate fuel to natural gas in a steam-based bitumen recovery process wherein bitumen is recovered from an underground reservoir.

BACKGROUND OF THE INVENTION

Steam-based bitumen recovery processes are most likely to burn natural gas as the fuel of choice to produce high-pressure steam for bitumen recovery. With the cost of producing steam the single greatest operating expense of bitumen recovery, the overall cost is greatly affected by the price of the fuel used in producing steam. Thus, the use of natural gas as a fuel for producing steam reduces operating costs when the price of natural gas is low but these costs will increase proportionally as the price of natural gas increases. As a result, interest in alternate fuels is particularly kindled when the price of natural gas increases. Previous studies have indicated that bitumen bottoms (resid, asphaltenes, etc.) are competitive as fuel with natural gas when the price of natural gas is higher than a certain level.

Investigations into the concept of using the whole or a separated component of the produced bitumen as an alternate fuel have been made for several years. Past investigators have generally focussed efforts on whole bitumen emulsification as opposed to efforts directed to separating or splitting the bitumen into distinct heavy and light fractions. Splitting the bitumen into heavy and light fractions can produce a higher value, lighter overhead fraction that can be marketed separately as a medium sour crude or be blended into the overall diluted bitumen pool and, a lower value residuum fraction that can be utilized as a fuel and preferably as an on-site fuel for steam generation.

Processes for splitting bitumen into two or more fractions are currently commercially available. Such processes include conventional fractionation with atmospheric and vacuum towers, or solvent de-asphalting to produce the desired resid fraction.

In conventional fractionation, the individual fractions are often cut sharper than might be necessary for an alternate fuel application such as an emulsion fuel for steam generation. Fractionation is also very cost intensive due to the equipment investments required. In fractionation, a crude oil is introduced into distillation columns, usually in a two-tower configuration. The first distillation tower operates at near atmospheric pressure (slightly positive) while the second tower operates under vacuum—the net pressure being a function of the crude oil type and the desired properties of the residuum fraction at the bottom of the column. The distillation columns are designed to maximize recovery of the valuable products from the crude oil, such as, gasoline, jet fuel, diesel, etc., and to recover the products as close to specification cut points as possible. Certain product specifications will require multiple trays in the towers as well as a condensed reflux stream from the top of the tower to strip the individual side streams of the heavier boiling components to meet boiling point specifications of the various products such as gasoline and jet fuels. The trays (or packings) represent a number of theoretical stages (vapor-liquid equilibrium) that are required to meet the cut point specifications of the individual streams.

In solvent desasphalting, bitumen is separated into heavy and lighter components with the addition of a light paraffinic solvent, typically a pure component such as propane or pentane, at a high solvent to bitumen ratio to separate the heavier asphaltic fraction into a distinct phase. Effective storing, recovering and recycling of the solvent is very energy and cost intensive.

A flash operation is distinct from a fractionation/distillation operation in that it only provides one theoretical stage per vessel. Within a flash operation vessel, no trays, reflux or side streams are present but rather only a top and a bottom product stream. The lack of trays, and side and reflux streams makes for poorer boiling point cut properties for the product streams. As a result, there may be significant overlap between the back-end of the lighter stream with the front-end of the heavier stream which for almost all petroleum refinery operations will not be commercially acceptable. However, for certain product requirements, flash separation is satisfactory if the individual product streams do not have to meet precise product specifications.

However, while it has been known that flash operations could potentially be used to separate bitumen, such technology has not been implemented in view of significant operational problems when separating bitumen. In particular, in a two-stage (atmospheric and vacuum) flash operation, there is a significant risk of the higher boiling point compounds migrating to the lighter stream overhead as a result of the lack of trays and/or reflux (particularly in the vacuum stage) which may result in plugging overhead lines. Thus, as a result of both the cut point specification and the risk of operational problems, the use of a highly viscous and asphaltic crude, such as Cold Lake or Athabasca bitumen per se has not been considered for flash operations.

Further, and with respect to the use of solvents for separation, a source of solvents not previously considered for bitumen separation is gas plant condensates, also referred to as gas plant diluent since the material is used to dilute the bitumen for transportation. Gas plant condensates (diluents) are used to dilute bitumen for transportation and generally include mixtures of paraffmic C4-C10 hydrocarbons as by-products of natural gas processing plants. During natural gas processing, various contaminants are removed through condensation to produce a significant volume of these by-product hydrocarbons. Gas plants are often located in relative proximity to bitumen recovery operations and, thus, can provide a ready source of solvents for use in a bitumen separation process.

After separation, the handling and burning of the heavier resid fractions is also difficult. Generally, the resid viscosity is too high to be pumped in its neat form due to its high density and viscosity requiring that the fraction be heated to 200° C. or higher.

Burning the resid fraction is also difficult in burner systems currently available as atomization of the fuel and the temperature at which it becomes amenable to atomization cracks the resid, leading to coke lay down and fouling of the fuel delivery system of the burner. Burning requires that the fraction be heated to over 325° C. in order to lower the viscosity to about 25 cP needed for atomization within a combustion chamber. Experimental work indicates that the resid starts to smoke at a temperature of about 280° C. and crack at about 300° C. Furthermore, and from a practical perspective, in order to obtain a bulk resid temperature of about 325° C. for atomization, the wall temperature of the storage vessel and/or the distribution piping has to be considerably higher than 325° C. which will result in wall coking of the storage vessel and/or distribution piping.

As a result of both the handling and burning problems, it has been known that one method to reduce the viscosity of various bitumens and/or their fractions is to create emulsions of bitumen in water. Emulsions break down the bitumen into small droplets which are dispersed in a continuous phase of water, thereby lowering the apparent viscosity for ease of pumping and transportation. Asphalt-in-water emulsions have been commercially produced for decades, with variations in composition and formulation designed to match specific end uses. However, in the past, the creation of stable emulsions of the heaviest bitumen fractions and particularly those fractions having a high softening point or density have required high temperatures and pressures to create and maintain a stable emulsion and have not been practical. Thus, there continues to be a need for methods which enable the heaviest fractions of bitumen to be formed into stable emulsions suitable for pumping, handling and burning.

In summary, while separation of bitumen into heavy and light fractions is known for various products, there continues to be a need for effective and efficient bitumen separation, handling and separation techniques for producing heavy or resid fractions of bitumen for use as an emulsion fuel. More specifically, there has been a need for an efficient fractionation process as well as processes to render the resid pumpable in order that the resid may be used as fuel for use as a component in an integrated process of steam-based bitumen recovery where a portion of the recovered bitumen is used as fuel to create steam for recovery of the bitumen.

A review of the prior art reveals that such processes have not been proposed. For example, the paper "Bitumen Utilization via Partial Upgrading and Emulsification" (Sankey, B. M., Ghosh, M., and Chakrabarty, T., 6$^{th}$ *UNITAR International Conference on Heavy Crude and Tar Sands,* Vol. 2 p. 269-276, Feb. 12-17, 1995) describes the concept of splitting bitumen and emulsifying the resid. This paper does not, however, disclose a two-step flash separation or the use of gas plant diluent to separate asphaltene.

Further patents have issued for the emulsification of various heavy oils and bitumen, but not for the type of recalcitrant resid used in this invention. For example, U.S. Pat. No. 4,666,457 describes emulsifying heavy oils in water, primarily for use of bio-emulsifiers and U.S. Pat. No. 6,113,659 discloses emulsifying heavy oil which is softer than the resid fraction of this invention.

SUMMARY OF THE INVENTION

In accordance with one aspect of the invention, there is provided a process of splitting bitumen into a heavy and light fraction and emulsifying the heavy fraction for use as a fuel comprising the steps of:

- splitting bitumen into a heavy and a light fraction in any one of or a combination of a two-stage flash separation process or a gas plant diluent separation process; and,
- emulsifying the heavier fraction with water to form a burnable fuel.

Preferably, the cut point of the heavy and light fraction is between approximately 490° C. and 510° C. and more preferably approximately 500° C.

In the case where step a) is a gas plant diluent separation process, it is preferred that the ratio of gas plant diluent to bitumen is 1:1 to 10:1 and more preferably 10:1. The gas plant diluents preferably have a composition comprising approximately 61-81 liquid volume (LV) % paraffins, 15-25 LV % naphthenes and 5-13 LV % aromatics. A typical gas plant diluent has a composition comprising 71 LV % paraffins, 20 LV % naphthenes and 9 LV % aromatics.

In another embodiment, the gas plant diluent separation process comprises the steps of:

- mixing gas plant diluent and bitumen in a ratio of 10:1 to 1:1 (diluent:bitumen) to create a bitumen/diluent mixture;
- allowing the bitumen/diluent mixture to settle for one to twenty four hours;
- separating a bottom solids portion and deasphalted oil portion; and,
- flashing residual diluent from the bottom solids portion.

In further embodiments, the ratio of water to heavier fraction in forming the emulsion is 10/90 to 50/50 by weight and more preferably 30/70 by weight.

In a further still embodiment, the process further includes the step of burning the fuel in a combustion chamber to produce high-pressure steam for steam-based bitumen recovery to recover bitumen as a produced water/bitumen mixture.

In yet another embodiment, the emulsification more specifically includes the steps of a) mixing water and surfactant to form a water/surfactant mixture; b) adding the water/surfactant mixture to a heated heavier fraction to form a heated emulsion; and, c) adding cool water to the heated emulsion to form a cooled emulsion having a temperature below the boiling point of water at ambient pressure. Preferably, the average particle size of the emulsion is less than 10 microns and, more preferably 2-5 microns. The total amount of water (by weight) added in steps a) and c) are preferably equal.

In a more specific embodiment, an integrated process of steam-based bitumen recovery and steam generation is provided comprising the steps of:

- splitting bitumen into a heavy fraction and a light fraction in any one of or a combination of a two-stage flash separation process and a diluent separation process;
- emulsifying the heavy fraction with water and an emulsifier to form a burnable fuel; and,
- burning the fuel in a combustion chamber to produce high pressure steam for steam-based bitumen recovery to recover bitumen as a produced water/bitumen mixture from an underground reservoir;
- separating the produced water/bitumen mixture in bitumen/water separator to produce bitumen for step a) and produced water, and,
- subjecting the produced water to a water treatment process to remove contaminants and to produce a treated water suitable for steam generation in step c).

BRIEF DESCRIPTION OF THE DRAWINGS

The invention is described with reference to the drawings wherein.

DETAILED DESCRIPTION OF THE INVENTION

Figure 1:
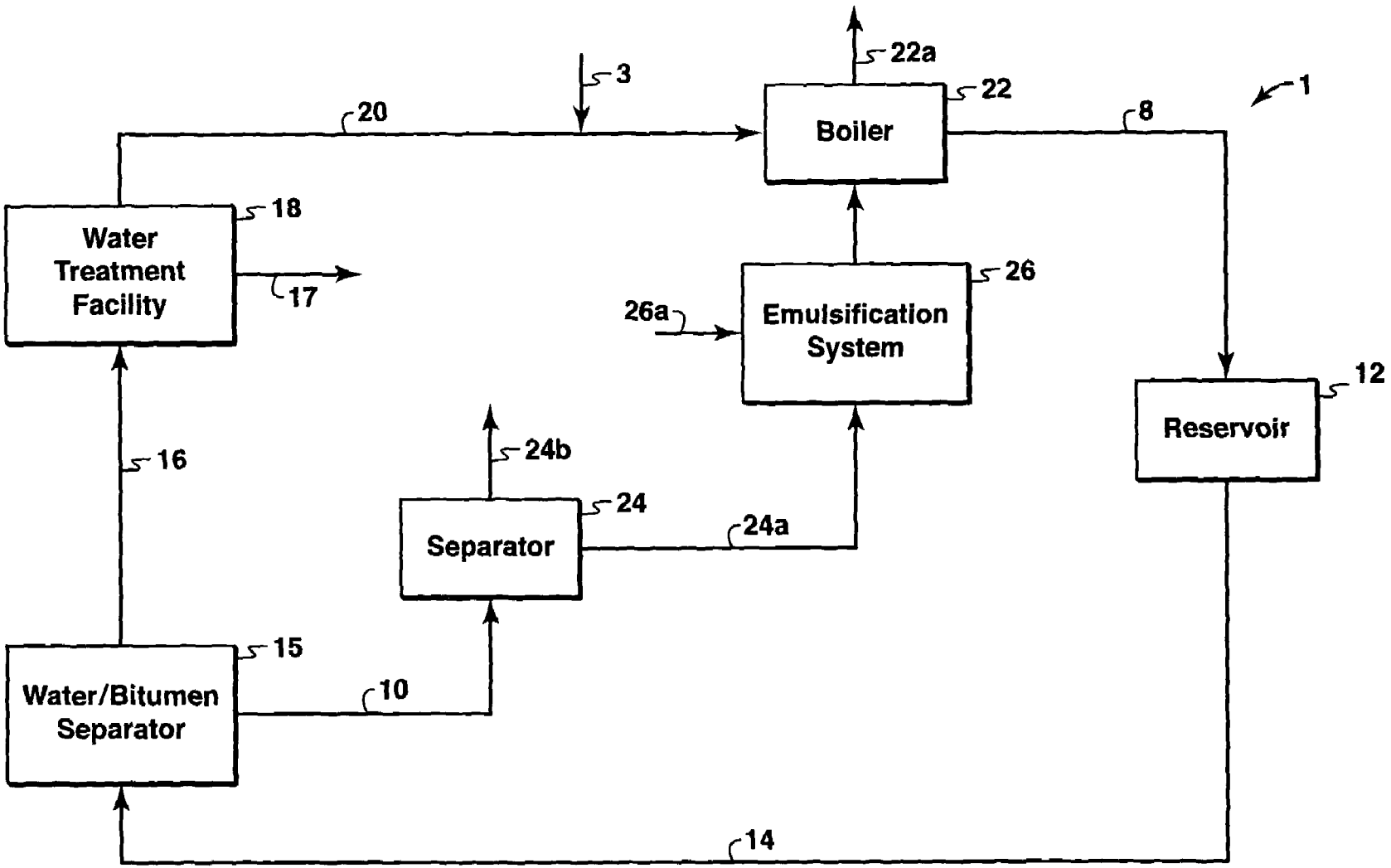
FIG. 1 is a schematic overview of a bitumen splitting and emulsification process in accordance with the invention within a bitumen recovery operation.

An overview of a bitumen splitting and emulsification process within a bitumen recovery operation is shown in FIG. 1.

In a thermal bitumen recovery operation 1, steam 8 is used to recover bitumen 10 from an underground reservoir 12 as a produced water/bitumen mixture 14. The produced water/bitumen mixture 14 is subjected to separation in a water/bitumen separator 15 to produce whole bitumen 10 and produced water 16. The produced water 16 is subjected to water treatment in a water treatment facility 18 to remove contaminating minerals 17 leached from the reservoir 12 during recovery. Treated water 20 from the water treatment facility 18 is introduced into a boiler 22 for creating steam 8 for re-injection into the reservoir.

The whole bitumen 10 generally contains both heavy and light components which may be separated from one another in a separation step 24 to create fractions having specific properties for various uses. Generally, the heavy fractions 24*a* contain heavier resid and ashphaltene components whereas the lighter fractions 24*b* contain various lighter components which may be refined to higher value products. The heavy 24*a* and light 24*b* fractions may be separated from one another by various separation technologies. In accordance with one aspect of the invention, the heavy and light fractions are separated using flash separation (FIG. 2) and in another embodiment are separated in a solvent separation process using gas plant condensates (FIG. 3).

In accordance with another aspect of the invention, the heavier fraction 24*a* may be emulsified in an emulsification system 26 (with emulsifying agents 26*a*) for use as a fuel for the production of high pressure steam 8 in a boiler 22 for use in the bitumen recovery operation. After the emulsified heavier fraction is consumed to produce high pressure steam, the residue 22*a* is typically eliminated.

Figure 2:
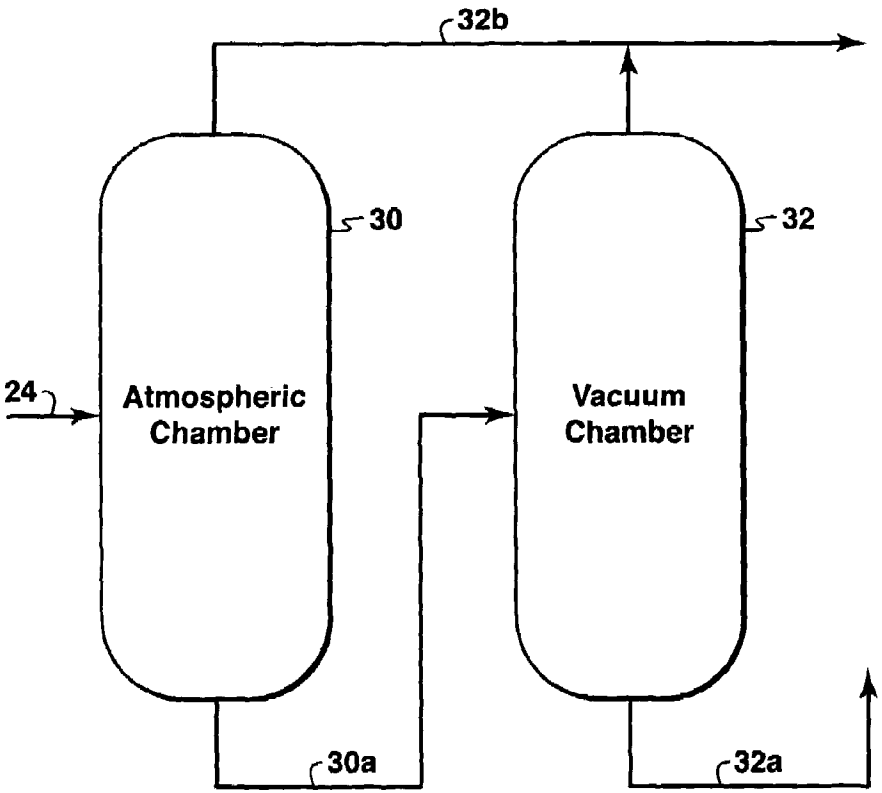
FIG. 2 is a schematic diagram of a two stage bitumen splitting process in accordance with one embodiment of the invention; and, FIG. 3 is a schematic diagram of a diluent bitumen splitting process in accordance with one embodiment of the invention.
Figure 3:
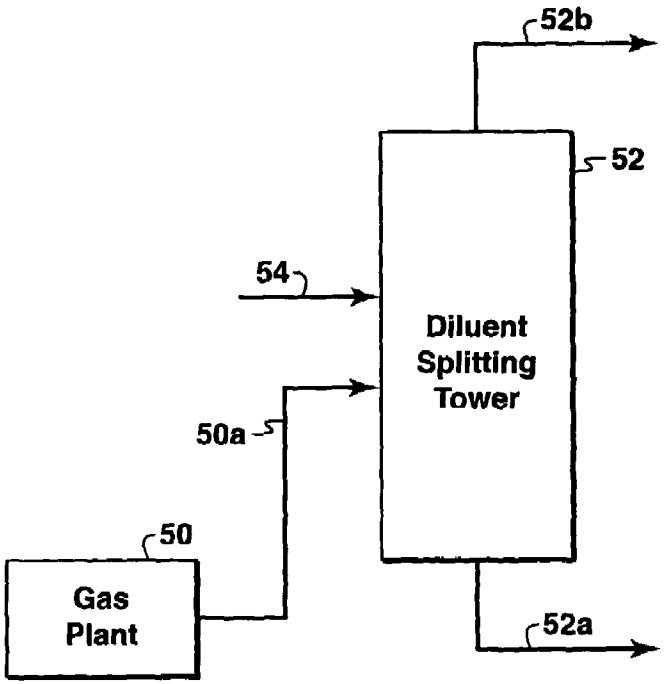

2. Flash Separation:

In one embodiment and with reference to FIG. 2, bitumen 10 is split into two fractions using a two-stage flash separation. As indicated above, while simple flash separation might be occasionally used in refinery process operations for light crude separations, flash separation for a heavy feed such as bitumen 10 has not been conducted possibly due to its high density, viscosity and asphaltene content. As shown, the flash separation system includes both a single stage atmospheric chamber 30 and a single stage vacuum chamber 32 wherein the bottom fraction 32*a* from the vacuum chamber removes a heavy fraction for subsequent use as a fuel and the upper fraction 32*b* removes a lighter fraction.

Cut points for the heavy and light fractions, although imprecise, are important to the success of this operation. The bottom residuum fraction can be fractioned at various cut points by adjusting the vacuum of the second flash vessel 32. It has been determined that a nominal cut point of 500° C.+ for the resid gives an overhead light fraction stream that can be shipped by pipeline without requiring any additional diluent and without causing pipeline plugging. A range in cut points from approximately 480-510° C. was tried and determined to be effective for flash separation. Cut point values above approximately 510° C. resulted in difficulties in maintaining vacuum as well as increased pumping difficulties. A 500° C.+ resid cut (see Table 1) is very recalcitrant resid as a fuel in the absence of emulsification.

Cut points may be determined by either ASTM distillation method (D-1160) or by simulated gas chromatographic distillation (GCD) method.

TABLE 1

Typical Resid Properties from Flash Separation with 500° C. + Cut Point

| | |
|---|---|
| Density, g/cc | 1.06 |
| Sulfur, wt % | 6.3 |
| Nitrogen, wt % | 0.7 |
| Metals (NI + V), wppm | (145 + 350) |
| Micro Carbon Residue (MCR), wt % | 24.0 |
| Carbon, wt % | 82.0 |
| Hydrogen, wt % | 9.3 |
| Viscosity, cSt | |
| 100° C. | 25,000 |
| 135° C. | 2,000 |
| 204° C. | 110 |
| Heptane Insoluble, wt % | 21.0 |
| Gross Heating Value, Btu/lb | 40940 kJ/kg |
| Net Heating Value, Btu/lb | 37450 kJ/kg |
| Ash Content, wt % | 0.20 |
| GC Distillation (LV % off) | T (° C.) |
| 5 | 500 |
| 10 | 525 |
| 20 | 570 |
| 30 | 605 |

2. Diluent Separation

A second embodiment of the invention for splitting bitumen into heavy and light fractions is through the use of a diluent. With reference to FIG. 3, a flow diagram shows splitting bitumen in a tower 52 with diluents such as gas plant condensates 50*a* which are normally readily available in bitumen production operations. A gas plant 50 produces gas plant condensates 50*a* (with a typical analysis shown in Table 2) which may be introduced into tower 52 with bitumen 54 to produce a heavy fraction 52*a* and a light fraction 52*b*.

TABLE 2

Typical Gas Plant Condensate Analysis

| | |
|---|---|
| Gravity, ° API | 69 |
| Viscosity, cST @ 15° C. | 0.6 |
| Total Sulfur, wt % | 0.1 |
| Total Nitrogen, wppm | 10 |
| Hydrogen, wt % | 14.8 |
| Carbon, wt % | 80.5 |
| Reid Vapour Pressure (RVP), kPa | 74.46 |
| Paraffins, LV % | 71 |
| Naphthenes, LV % | 20 |
| Aromatics, LV % | 9 |
| GC Distillation LV % Off | T (° C.) |
| 5 | 24 |
| 10 | 26 |
| 20 | 37 |
| 30 | 40 |
| 40 | 62 |
| 50 | 72 |
| 60 | 89 |
| 70 | 101 |
| 80 | 125 |
| 90 | 161 |
| 95 | 204 |
| 99 | 335 |

While traditional deasphalting uses pure component light paraffinic solvents (typically C3 or C4) for deasphalting, recovering and recycling the solvent is of utmost importance in view of the value of these solvents. In the subject invention, the use of gas plant condensates for solvent separation provides economic advantages as 1) gas plant condensates are generally available on site thus decreasing or eliminating solvent transportation costs and 2) gas plant condensates do not need to be recovered from the overhead stream but rather can economically form a component of the overall lighter fraction stream which may reduce the amount of diluent that must be added to the bitumen pool to facilitate transport of the bitumen product.

More specifically, the asphaltic heavy bottom phase 52*a* separates out and is used as fuel and the lighter overhead phase 52*b*, which is mixed with the gas plant condensate, goes to the overall diluted bitumen pool. Various ratios of diluent to bitumen were investigated in the laboratory to determine how to minimize diluent loss in the bottom phase as well as to control the amount of bottom phase provided through separation.

3. Emulsification of Heavier Fraction of Bitumen

The emulsification and process of emulsifying heavy fractions of bitumen for use as a fuel are affected by parameters including water content, surfactant chemistry and the specific emulsification process employed.

With respect to water content, less water is preferred in order to maintain combustion efficiency. However, more water helps disperse the resid in the emulsion. A typical and preferred water content of 30% (by weight in the emulsion) was established by trial and error in the bench scale work, although it can range from 10% to 50% water (by weight in the emulsion). Still higher proportions of water are possible, but will more significantly impact the efficiency of combustion and the costs of transportation.

As indicated above, the high viscosity of the resid fractions requires both elevated temperatures and pressures to keep the water component of the emulsion in the liquid form. Both static and dynamic mixing devices, such as colloid mills can be employed to provide shear energy for dispersing the resid in water. However, both approaches require quenching of the emulsion to bring the temperature of the emulsion below the boiling point of water at ambient pressure.

In the present invention, the emulsion is created by adding approximately 50% of the final water amount containing the surfactant to the resid heated in a contained system such as a drum heater. This step is followed by a quenching step in which cold water (without surfactant and comprising the remaining 50% of the final water amount desired) is added to the emulsion to cool the emulsion. The heated resid and surfactant water are preferably pumped through a static mixer to create the hot emulsion and the cold water is added to the hot emulsion prior to passing through a second static mixture. The emulsion may be further cooled using a heat exchanger to form a cool emulsion having a water content of about 30% (by weight of total emulsion) and a temperature below the boiling point of water at ambient pressure.

A smaller emulsion particle size is preferred to maximize combustion efficiency by maximizing the surface area of particles available for combustion. Preferably, the average particle size of the emulsion is less than 10 microns and preferably in the order of 2-5 microns. The use of colloid mixers to create the emulsion in conjunction with various surfactant formulations can produce stable emulsions in these ranges.

The emulsification of a 500° C.+ resid required the use of surfactants to create emulsions having a suitable stability for storage and transportation. Different formulations can be utilized for short-term and long-term storage stability.

All three classes of surfactants (emulsifiers), including anionic, cationic and non-ionic, can be utilized depending upon the operational parameters of the plant and the water quality available, and consideration of the advantages and disadvantages of each class of surfactant, including the stability of the surfactant at high temperatures.

Anionic surfactants contain sodium or potassium ions that can lead to sodium vanadate scale in the combustion chamber. However, the addition of a magnesium salt, preferably a water-soluble formulation of magnesium hydroxide, can alleviate this problem and, thus, in certain cases, anionic emulsifiers are an appropriate choice of surfactant.

Cationic surfactants require low pH in the emulsion and may cause corrosion in the combustion chamber. Cationic surfactants are less expensive than anionic surfactants and, thus, depending on the metalurgy of the boiler tubes and other piping, an economic case for the use of cationic surfactants could be made in certain situations.

Non-ionic surfactants are effective in creating emulsions with water containing a wide range of total dissolved solids and ions. For example, brackish water (which contains high amounts of sodium and chloride ions) can be used for making an emulsion using a non-ionic surfactant with an appropriate magnesium pacifier. Moreover, non-ionic surfactants do not affect the pH of the water and, thus, are less difficult to handle. A mixture of oil-soluble and a water-soluble non-ionic surfactants produces a better emulsion than that by a single water-soluble non-ionic surfactant.

EXAMPLES

Example 1

Flash Separation

Bitumen was subjected to a batch flash separation process in which the vacuum pressure was controlled to provide an appropriate cut point determined by simulated gas chromatographic distillation (GCD) method although other methodologies such as ASTM distillation method D-1160 can also be used and are known to persons skilled in the art.

Example 2

Diluent for Splitting Bitumen

A series of diluent separation tests were performed with various ratios of diluent to bitumen. The procedure involved weighing an amount of bitumen, adding appropriate volumes of diluent, shaking the mixture for 10 minutes and then letting it settle for one to twenty four hours; depending on the test criteria. At the end of the settling period, the sample was centrifuged for 10 minutes at 1500 rpm. After pouring off the deasphalted light fraction, the bottom solids were rinsed with diluent, centrifuged and the solids were separated. This procedure was repeated until the decanted liquid was clear. The solids were then subjected to atmospheric drying for one hour followed by oven drying for another hour at 50° C. After cooling for 45 minutes, the dried solids were weighed to determine the amount of resid separated from the bitumen.

Table 3 shows the diluent/bitumen ratio vs. the amount of resid separated from the bitumen weighed after one hour of settling. The settling time range of one to twenty four hours made very little difference (−1%) in the yield of resid removed from the bitumen.

TABLE 3

Impact Of Diluent Volume On Resid Yield

| Diluent/Bitumen Ratio | % Resid removed from Bitumen |
|---|---|
| 1:1 | 0.45 |
| 2:1 | 0.75 |
| 5:1 | 10.40 |
| 7:1 | 13.67 |
| 10:1 | 14.57 |

A comparison was made of the relative efficiencies of various pure component alkanes vs. the gas plant condensate in removing resid. Table 4 shows the relative amounts of resid precipitated by the various solvents at 2:1 solvent to bitumen ratio.

TABLE 4

Resid Yield At 2:1 Solvent/Bitumen Ratio

| Solvent | % Resid removed from Bitumen |
|---|---|
| Pentane | 13.73 |
| Hexane | 2.48 |
| Heptane | 4.22 |
| Gas Plant Condensate | 0.75 |

While it is clear that the gas plant condensate is not nearly as efficient as other lighter solvents, at higher solvent/bitumen ratio, it produces a desirable amount of sufficient separation to meet fuel requirements for a typical bitumen recovery operation. Further, the use of gas plant condensates is advantaged over pure and lighter solvents in that they do not have to be recovered and recycled as in conventional deasphalting operations. That is, the solvent/diluent along with the deasphalted light fraction can be blended with the rest of the diluted bitumen pool for the market or further downstream processing.

Example 3

Preparation of Emulsion

Cold Lake vacuum resid (510° C.+) was preheated to 156° C. in a drum heater. To this resid, an oil-soluble ethoxylkated nonyl phenol with four moles of ethylene oxide (EO) was added. Surfactant water containing an ethoxylated nonyl phenol with 40 EO groups was preheated to 65° C. The total surfactant concentration in the product emulsion was 1.5% by weight of which 70% by weight was the ethoxylated nonyl phenol with 40 EO groups.

The hot resid and hot surfactant water were pumped separately in an 80: 20 ratio through a static mixer combination with the first static mixer having a 1.27 cm diameter with 7 elements and the second static mixer having a 0.48 cm diameter with 14 elements.

The emulsion resulting from the first static mixer combination was cooled from 122° C. to 105° C. by mixing it with quench water at 4° C. in a 0.95 cm static mixer with 21 elements. The final water content in the emulsion was 29% by weight. The emulsion was further cooled down to 80° C. in a copper tube coil immersed in an ice bath.

The maximum fluid velocity in the system was 8.9 m/s with a corresponding shear rate of 42500 s-1.

To reduce the gelling tendency of the emulsion during transportation, 200 ppm of NaOH (based on emulsion) was added to the emulsion. The median particle size of the emulsion was 5.2 um and the viscosity of the emulsion was 186 cp at 21° C.

Example 4

Combustion of Bitumen Resid Emulsion Fuel vs No. 6 Fuel Oil

A test burn was conducted in a 2 GJ/hr tunnel furnace to compare the relative combustion characteristics of a bitumen resid emulsion fuel and standard No.6 fuel oil. This bitumen resid fuel was prepared from a resid cut of 510° C.+ in a 71% resid/29% water emulsion as described in Example 3.

The temperature at the burner of the emulsion fuel was 41-46° C. whereas for the fuel oil it was heated to about 91° C. due to its higher viscosity. Both were air-atomized. The atomization air rate and pressures at the burner were optimised for each fuel but were very comparable in a narrow range, viz, 28-32 kg/hr and 434-503 kPa respectively. The combustion air rate was also maintained close at 499-513 kg/hr at normal temperature and pressure.

Most combustion and heat transfer characteristics were found to be very comparable between the two fuels. The heat transfer rate for the emulsion fuel was 0.181-0.189 kW/MJ compared to 0.196 kW/MJ for that of the fuel oil. The total heat transfer in the cooling surfaces was measured to be 2.56-2.79 W/cm$^2$ for the emulsion fuel vs 2.73 W/cm$^2$ for the fuel oil. The amount of thermal energy input extracted in the cooling plates was 65.2-68.1% for the emulsion fuel vs 70.4% for the fuel oil. Similarly, the flue gas temperature, flowrate and particulates loading were very comparable for the emulsion fuel and the fuel oil at 494-512° C. vs. 528° C., 0.272 Nm$^3$/MJ vs. 0.266 Nm$^3$/MJ and 0.229-0.355 g/Nm$^3$ vs. 0.264 Nm$^3$/MJ respectively. The fuel oil was combusted with a little less excess air and had about a third less nitrogen in the fuel, but the NOx number was marginally higher at 0.092 g/MJ vs 0.078-0.080 g/MJ for the emulsion fuel, due to its hotter burning flame. The $SO_2$ emission was a direct function of the sulfur content of the fuel and No.6 fuel oil had 2.14% sulfur, only about a third that of the emulsion fuel. The axial and the radial gas temperature profiles followed parallel trends with the fuel oil case temperature being a few degrees hotter. The total axial heat fluxes were almost indistinguishable.

Accordingly, the emulsion fuel is suitable for use as a fuel for steam generation.

The invention claimed is:

1. A process of splitting bitumen into a heavy and light fraction and emulsifying the heavy fraction for use as a fuel comprising:

a) splitting a bitumen feed into a heavy and a light fraction with a gas plant diluent wherein the gas plant diluent has a composition comprising 61-81 LV % paraffins, 15-25 LV% naphthenes and 5-13 LV % aromatics, and the ratio of gas plant diluent to bitumen is 1:1 to 10:1; and, b) emulsifying the heavier fraction with water to form a burnable fuel.

2. A process as in claim 1 wherein the cut point of the heavy and light fraction is 490° C. to 510° C.

3. A process as in claim 1 wherein the cut point of the heavy fraction and light fraction is 500° C.

4. A process as in claim 1 wherein the ratio of gas plant diluent to bitumen is 10:1.

5. A process as in claim 1 wherein the gas plant diluent has a composition comprising 71 LV % paraffins, 20 LV % naphthenes, and 9 LV % aromatics.

6. A process as in claim 1 wherein the gas plant diluent separation process comprises:

a) mixing gas plant diluent and bitumen in a ratio of 10:1 to 1:1 (diluent:bitumen) to create a bitumen/diluent mixture;

b) allowing the bitumen/diluent mixture to settle for at least one and no more than twenty four hours;

c) separating a bottom resid portion and a deasphalted light portion; and, d) flashing remaining diluent from the bottom resid portion.

7. A process as in claim 6 wherein the bitumen:diluent ratio is 1:10 to 1:5.

8. A process as in claim 1 wherein the ratio of water to heavier fraction in step b) is 10:90 to 50:50 by weight.

9. A process as in claim 8 wherein the ratio of water to heavier fraction in step b) is 30:70 by weight.

10. A process as in any one of claims 1-9 further comprising the step of burning the fuel in a combustion chamber to produce high pressure steam for steam-based bitumen recovery to recover bitumen as a produced water/bitumen mixture from an underground reservoir.

11. A process as in claim 1 wherein emulsifying the heavier fraction comprises:

a) mixing water and surfactant to form a water/surfactant mixture;

b) adding the water/surfactant mixture to a heated heavier fraction to form a heated emulsion; and, c) adding cool water to the heated emulsion to form a cooled emulsion having a temperature below the boiling point of water at ambient pressure.

12. A process as in claim 11 wherein the average particle size of the emulsion is less than 10 microns.

13. A process as in claim 11 wherein the average particle size of the emulsion is at least 2 and not more than 5 microns.

14. A process as in claim 11 wherein the total amount of water (by weight) added in steps a) and c) are equal.

15. An integrated process of steam-based bitumen recovery and steam generation comprising:

a) splitting a bitumen feed into a heavy fraction and a light fraction with wherein the gas plant diluent has a composition comprising 61-81 LV % paraffins, 15-25 LV % naphthenes and 5-13 LV % aromatics, and the ratio of gas plant diluent to bitumen is 1:1 to 10:1;

b) emulsifying the heavy fraction with water and an emulsifier to form a burnable fuel;

c) burning the fuel in a combustion chamber to produce high pressure steam for steam-based bitumen recovery to recover bitumen as a produced water/bitumen mixture from an underground reservoir;

d) separating the produced water/bitumen mixture in a bitumen/water separator to produce bitumen, a portion of which is used for step a) and produced water; and, e) subjecting the produced water to a water treatment process to remove contaminants and to produce a treated water suitable for steam generation in step c).

* * * * *